US005355988A

United States Patent [19]

Shirasawa

[11] Patent Number: 5,355,988

[45] Date of Patent: Oct. 18, 1994

[54] COIN SUPPLY DEVICE FOR COIN-OPERATED GAMING MACHINE

[75] Inventor: Masaharu Shirasawa, Tochigi, Japan

[73] Assignee: Kabushiki Kaisha Universal, Tochigi, Japan

[21] Appl. No.: 776,165

[22] Filed: Oct. 15, 1991

[30] Foreign Application Priority Data

Oct. 15, 1990 [JP] Japan ..... 2-277122

[51] Int. Cl.[5] ..... G07F 9/08

[52] U.S. Cl. ..... 194/217; 194/343; 453/32; 453/56; 198/455

[58] Field of Search ..... 194/217, 218, 317, 343, 194/346; 453/7, 11, 32, 56; 273/138 A; 198/455

[56] References Cited

U.S. PATENT DOCUMENTS

| | | | |
|---|---|---|---|
| 719,459 | 2/1903 | Goetze et al. | 453/56 X |
| 2,792,100 | 5/1957 | Reis . | |
| 3,621,854 | 11/1971 | Redman | 453/56 |
| 4,342,384 | 8/1982 | Fukase et al. | 453/56 X |
| 4,457,320 | 7/1984 | Diamond | 194/343 X |
| 4,462,414 | 7/1984 | Gordon . | |
| 4,884,992 | 12/1989 | Grimes | 453/29 |
| 5,059,153 | 10/1991 | Goi | 453/11 |

FOREIGN PATENT DOCUMENTS

| | | |
|---|---|---|
| 580467 | 1/1989 | Australia . |
| 2-57284 | 2/1990 | Japan . |

*Primary Examiner*—F. J. Bartuska
*Attorney, Agent, or Firm*—Young & Thompson

[57] ABSTRACT

A coin supply device includes a conveyor belt and a separating roller disposed above the conveyor belt. Upper coins of two or more overlapping coins are pushed back and separated by the separating roller rotating in a direction opposite to that of the conveyor belt. The lowermost coin is allowed to pass beneath the separating roller, and is fed to a pay-out hopper apparatus after passing under a coin sensor.

10 Claims, 5 Drawing Sheets

COIN SUPPLY DEVICE FOR COIN-OPERATED GAMING MACHINE

BACKGROUND OF THE INVENTION

1. Field of the Invention

The present invention relates to a coin supply device, and more particularly to a device for supplying coins to a coin-operated gaming machine in order to play a game.

2. Description of Related Art

In coin-operated gaming machines such as slot machines, a coin or token must be inserted in a coin inlet before a game can begin. At least one coin is required to play one game. To increase the number of prize-winning lines for the purpose of increasing the probability of winning a prize, or to increase the odds for a dividend of a prize, two or three coins are inserted.

In conventional slot machines, it is necessary for the player to insert at least one coin manually, coin by coin for each game, which is a highly laborious operation. To automate the supply of coins to the slot machine, there has been proposed in Japanese Patent Laid-Open Publ. No. 2-57284 a coin supply apparatus in which a rather great number of coins are put in a coin-receiving portion at one time, and coins are thereafter fed automatically one by one before each game. Coins put in the coin receiving portion of this coin supply apparatus are supplied to a hopper device, which is actuated before a game is played. A coin fed from this hopper device is detected by a coin sensor, and thereafter enters a hopper apparatus provided for pay-out in the event of a win. The slot machine is thereby in a state in which the coin has been supplied to the slot machine.

However, the hopper device of the coin supply apparatus described in the above document includes a revolving member having recesses formed on its periphery for receiving the respective coins in order to feed the successively. This coin supply apparatus therefore still suffers from the disadvantage that it must be large in size.

SUMMARY OF THE INVENTION

It is therefore an object of the present invention to provide a coin supply device that can be of a comparatively small size.

In order to achieve the above and other objects and advantages of the invention, a coin supply device is provided that comprises: a coin containing portion for receiving a plurality of manually-inserted coins; as first conveyor belt traveling about a first downstream roller and a second upstream roller for conveying the coins supplied from the coin containing portion; a first guide wall provided along the conveying direction of the first conveyor belt substantially perpendicular relative to the first conveyor belt for defining a direction of movement of the supplied coins from a lateral side; and a separating roller provided above the downstream roller and defining a spacing D together with the first conveyor belt described by the relation $T<D<2T$ where T is the thickness of a coin or token of a predetermined type, for rotation in the same direction as the first downstream roller thereby to convey the lowermost coin of the supplied overlapping coins on the first conveyor belt to the coin-operated machine and to push back coins overlying the lowermost coin. All of the coins received in the coin supply device according to the present invention can thus be fed successively to the slot machine. According to this design, the size of the coin supply device can be smaller than that of a conventional coin supply device.

In a preferred embodiment, a second conveyor belt is disposed downstream of the first conveyor belt for receiving and transporting the coins fed one by one through the spacing D. The second conveyor belt is driven at a speed greater than that of the first conveyor belt in order to increase the spacing between the coins supplied from the first conveyor belt.

BRIEF DESCRIPTION OF THE DRAWINGS

The above objects and advantages of the present invention will become more readily apparent from the following detailed description when read in connection with the accompanying drawings, in which.

DETAILED DESCRIPTION OF PREFERRED EMBODIMENTS OF THE INVENTION

Figure 1:
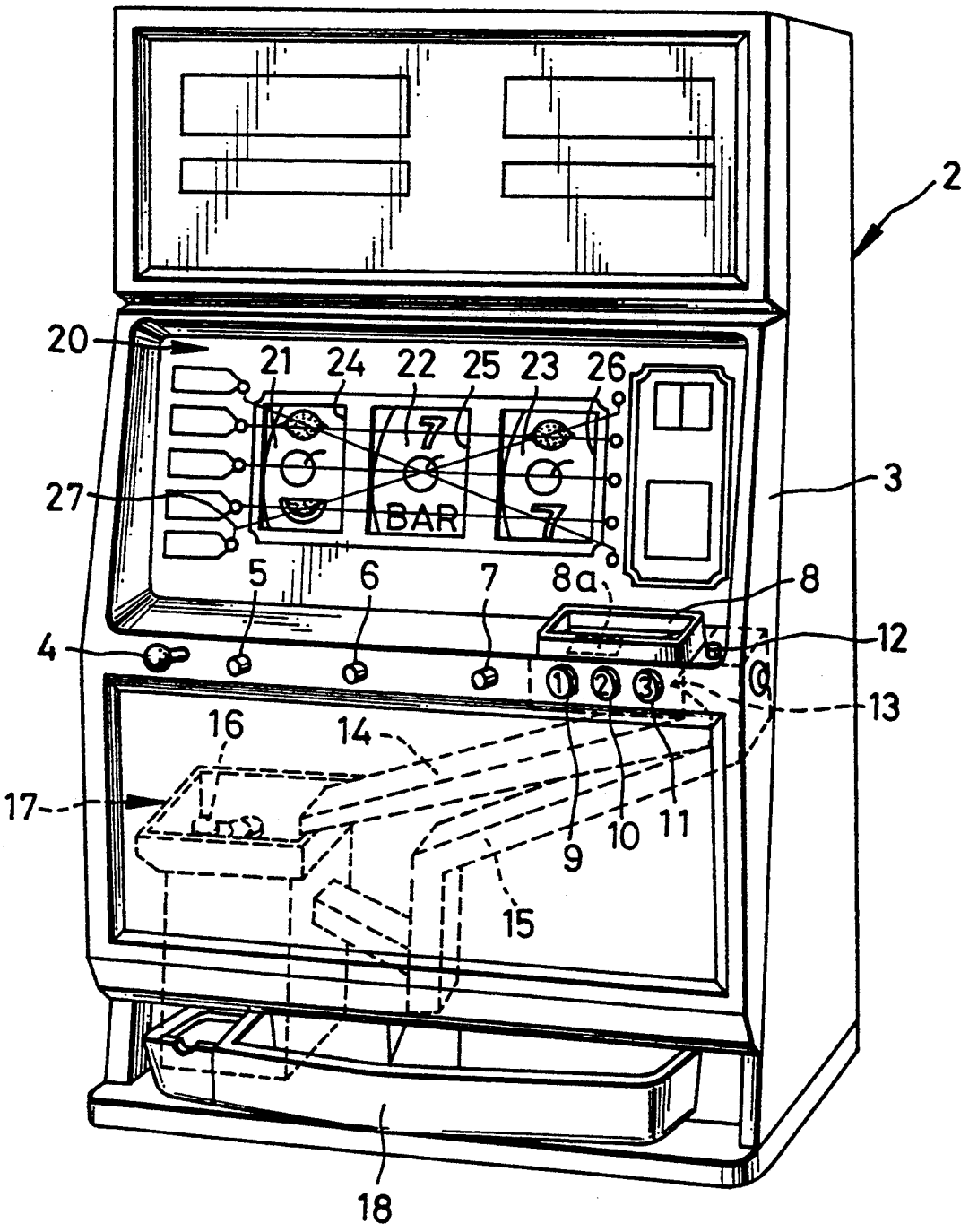
FIG. 1 is a perspective view illustrating a slot machine incorporating a coin supply device in accordance with the present invention.

FIG. 1 shows a slot machine 2 incorporating a coin supply device according to the present invention, having a front door 3 that opens with respect to the main body of the slot machine 2. This front door 3 is provided with a start button 4, stop buttons 5 to 7, and a coin containing portion 8 adapted to receive at once a rather large number of coins 16, coin number specifying buttons 9 to 11, and a return button 12 for returning the inserted coins 16.

Inside the coin containing portion 8 and under the opening 8*a* formed within the coin containing portion 8, there is disposed the coin supply device 13 according to the present invention, to be described in detail herein. Two coin passageways or coin chutes 14 and 15 are connected to the downstream side of the coin supply device 13, as is indicated by the broken line in the drawings. The lower parts of the coin chutes 14 and 15 extend to a hopper apparatus 17 and a coin tray 18, respectively.

A front panel 20 is mounted on the supper part of the door 3 above the stop buttons 5 to 7. Three reels 21 to 23 are rotatably disposed on the rear side of the front panel 20, and start rotating upon operation of the start button 4 after coins have been supplied. Each reel 21 to 23 bears on its periphery various symbols such as "7", "orange" and "BAR". These symbols can be observed through three windows 24 to 26 formed in the front panel 20. A plurality of prize-winning lines 27 traverse the windows 24 to 26. The number of designated lines in effect is increased when a greater number of coins are designated.

While the respective reels 21 to 23 are rotating, the stop buttons 5 to 7 can be actuated after the reels have reached a steady speed of rotation. When the stop buttons 5 to 7 are actuated at desired time intervals, stop control is initiated to stop the respective reels 21 to 23, whereupon a symbol combination is displayed corresponding to the times at which the stop buttons 5 to 7 are actuated, along the effective prize-winning line 27.

If the symbol combination that stops on the effective prize-winning line 27 is a prize-winning symbol combination, then the number of coins corresponding to the prize-winning rank of that combination are paid out of the hopper apparatus 17 into the coin tray 18. In case no buttons have been actuated within a predetermined period of time, the respective reels 21 to 23 are sequentially stopped by an automatic stop mechanism that is known per se.

Figure 2:
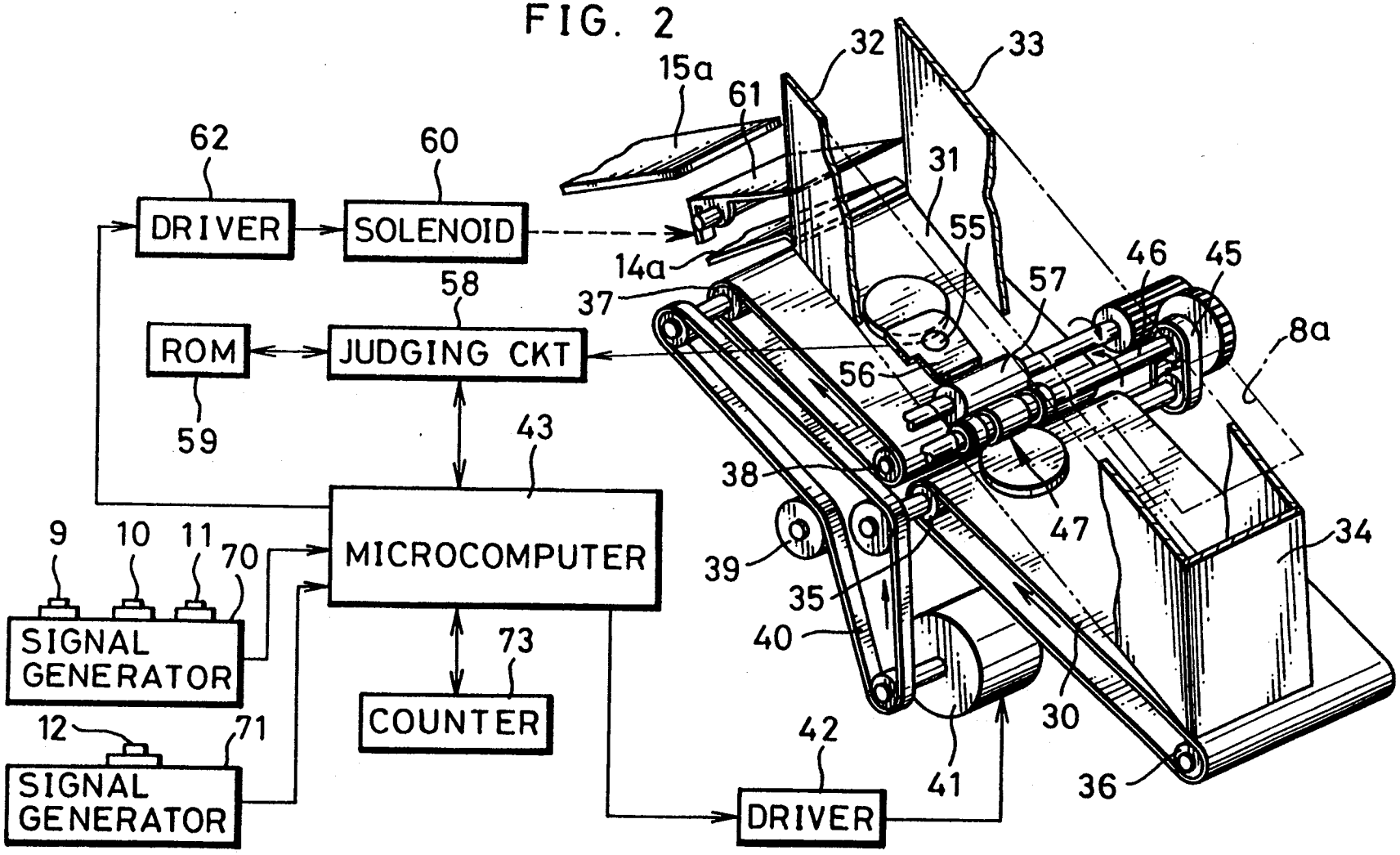
FIG. 2 is a schematic view illustrating the coin supply device shown in FIG. 1.

FIG. 2 illustrates the coin supply device 13, in which a first conveyor belt 30 is disposed below the opening 8*a* within the coin containing portion 8 as indicated by the chain line, for conveying coins 16 disposed laying on their sides thereon. At a location downstream of the first belt 30, a second conveyor belt 31 is arranged and driven at a conveying speed greater than that of the first belt 30. On the upper surfaces of the first and second belts 30 and 31, a pair of parallel guide walls 32 and 33 are provided extending obliquely relative to the conveying direction of the belts 30 and 31. The two belts 30 and 31 are so oriented that the lower lateral edge of the side of the guide wall 32 is disposed lower than that of the side of the guide wall 33. The guide wall 32 is thus in contact with the coins 16 fed by the belts 30 and 31. A partition wall 34 interconnects and is formed on the rear ends of the walls 32 and 33. The walls 32 and 33, the partition wall 34 and a partition wall 48 to be described later define together a space where coins 16 to be supplied are received and positioned over the first belt 30.

The first belt 30 travels about a drive roller 35 and a follower roller 36, and is rotated in the direction of the associated arrow shown in FIG. 2. The second belt 31 travels about a drive roller 37 and a follower roller 38 for rotating in the direction f the associated arrow. The drive rollers 35 and 37 are driven by a motor 41 via a timing belt 40 which is regulated as to tension by a pulley 39. The motor 41 is controlled via a driver 42 and a microcomputer 43, thereby to control the coin supply device 13.

A shaft 46 is disposed above the drive roller 35 for rotation via a belt 45 in the same direction of rotation as the drive roller 35, or opposite to the direction in which the coins 16 are conveyed, and is supplied by the walls 32 and 33 in parallel with the drive roller 35. A separating roller 47 is secured to the shaft 46 between the guide walls 32 and 33, and separate the overlapping coins 16 one by one by pushing overlying coins in the direction opposite that of transport.

Figure 3:
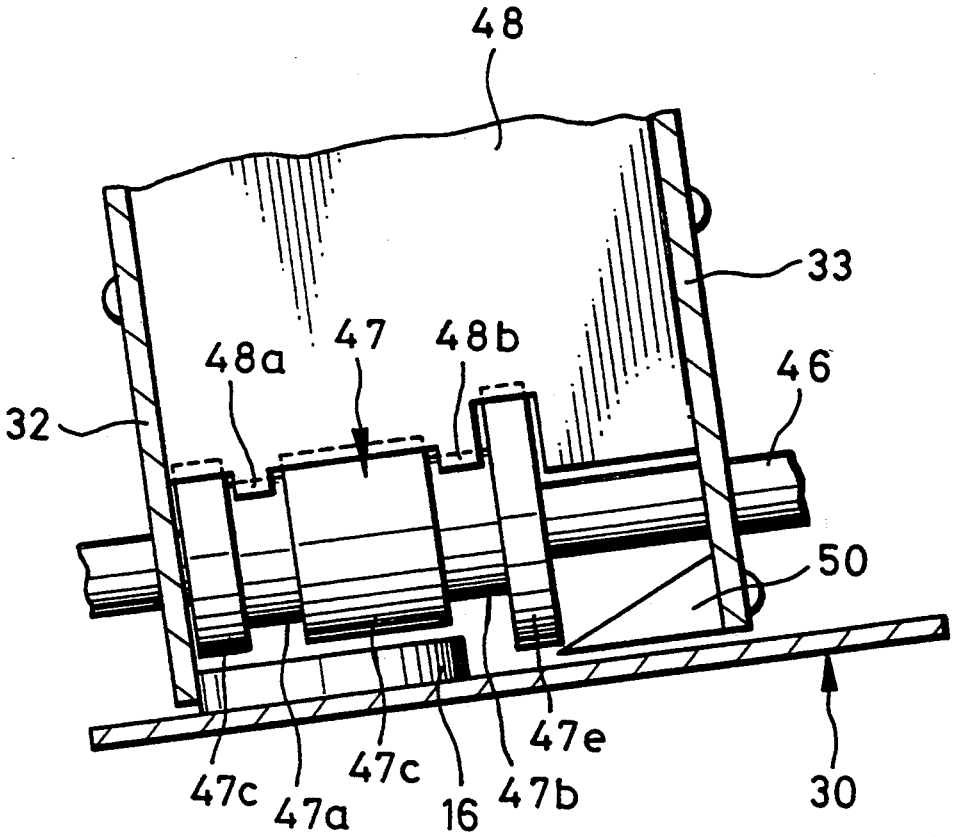
FIG. 3 is a sectional view illustrating a portion of the coin supply device shown in FIG. 1.

As shown in FIG. 3, the separating roller 47 is constituted by roller cylinders 47*c* of a smaller diameter and a side roller portion 47*e* of a larger diameter. Two annular grooves 47*a* and 47*b* are formed between and beside the roller cylinders 47*c* around the shaft 46 at a spacing less than the diameter of a predetermined coin or token. The spacing between the peripheral surfaces of the roller cylinders 47*c* and the first belt 30 is determined to be greater than the thickness of the predetermined coin or token, yet less than twice that thickness, so that only the lowermost coin can be conveyed beneath the roller cylinders 47*c* and passed through the spacing defined thereby. The spacing between the peripheral surface of the side roller portion 47*e* and the first belt 30 is less than the thickness of the predetermined coin or token, so that any lowermost coin in contact with the side roller portion 47*e* is returned by rotation of that portion. The spacing between the guide wall 32 and the side roller portion 47*e* is less than twice the diameter of the predetermined coin or token, so as to allow passage of only one coin at a time under the roller cylinders 47*c*.

Figure 4:
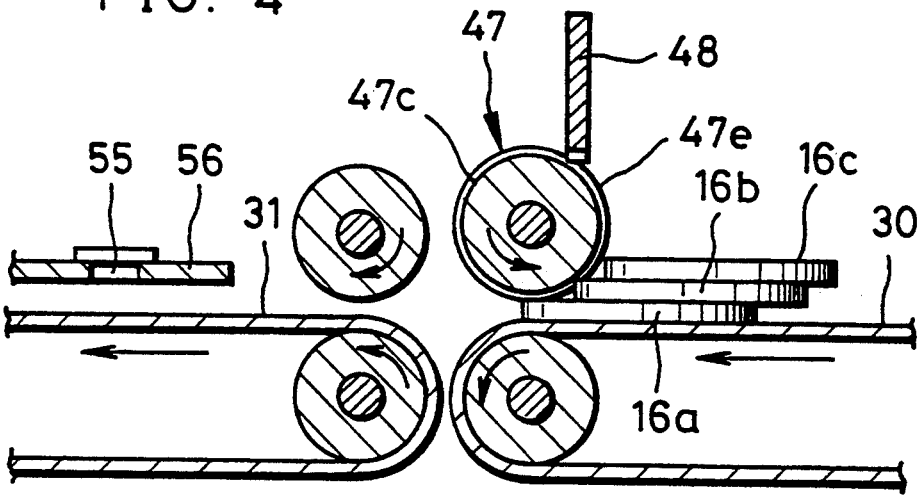
FIGS. 4 to 8 are explanatory views illustrating the operating states of two conveyor belts and a separating roller of the coin supply device.

A partition wall 48 is provided above the separating roller 47 (see FIG. 4). Projections 48*a* and 48*b* are formed on the lower edge of the partition wall 48 and extend into the grooves 47*a* and 47*b*, thereby to prevent the coins 16 from advancing between the partition wall 48 and the separating roller 47 which in this position turns in the direction of pulling the coins 16. A guide portion 50 is formed on the lower edge of the wall 33 along the transport direction, and is provided with an inclined surface on its upper side, which causes the coins 16 situated on the guide portion 50 to slide toward the guide wall 32 until reaching the surface of the first belt 30.

As shown in FIG. 2, a magnetic sensor 55 is disposed above the second belt 31 for detecting the coins 16 one by one, and is secured to the guide wall 32 via a sensor holder 56. Between the sensor holder 56 and the separating roller 47, there is disposed a nip roller 57 that is rotated by the shaft 46 via a gear. The nip roller 57 maintains the coins 16 pressed against the second belt 31 so as to prevent them from contacting the sensor holder 56 (see FIGS. 7 and 8).

The magnetic sensor 55 supplies to a judging circuit 58 a detecting current corresponding to the diameter of a detected coin. The judging circuit 58 converts the analog detecting current to a digital signal, and compares the digital signal with a reference signal written in a ROM 59. If the digital signal is equal to the reference signal, then the judging circuit 58 supplies the microcomputer 43 with a RIGHT signal representing detection of a genuine coin or a predetermined token. If the digital signal differs from the reference signal, then a WRONG signal is supplied representing a false or unacceptable coin or token.

It should be noted that a photosensor of a reflection type may be used for detecting the coins 16, instead of the magnetic sensor 55 of the present embodiment.

Two passage plates 14*a* and 15*a* are positioned downstream of the second belt 31, and constitute bottom surfaces of the coin chutes 14 and 15 through which the coins 16 slide on the passage plate 14*a* or 15*a* and pass down to the hopper apparatus 17 or the coin tray 18, respectively. For selection of the coin chutes 14 and 15, a swingable guide plate 61 is swung by a solenoid 60 and is changed over. The solenoid 60 is connected to the microcomputer 43 via a driver 62, and is driven thereby when a WRONG signal is output. The solenoid 60 is prevented by the microcomputer 43 from being driven when a RIGHT signal is output, or after passage of a predetermined time period.

There are also signal generators 70 and 71, and a subtractive counter 73 each connected to the microcomputer 43. The coin number specifying buttons 9 to 11 are provided on the signal generator 70 for specifying the number of coins to be played in a game as one, two or three coins respectively. The signal generator 70 supplies the microcomputer 43 with a coin number specifying signal corresponding to one of the buttons 9 to 11. The coin number specifying signal is supplied to the counter 73 via the microcomputer 43 so as to set in the counter 73 the corresponding number of coins to be played. The count of the counter 73 is decremented by one each time a RIGHT signal is supplied by the judging circuit 58. Upon each decrement of the counter 73, one detected coin or token of predetermined character is conveyed down the passage plate 14*a* of the coin chute 14 toward the hopper apparatus 17.

If a WRONG signal is supplied, no decrement is effected in the counter 73, such that the detected coin is conveyed on the passage plate 15*a* of the coin chute 15 toward the coin tray 18, because the solenoid 60 is driven upon detection of the WRONG signal to swing the swingable plate 61. When the number of coins to be played in the counter 73 becomes "zero" after repeated decrementation of the stored count, then the microcomputer 43 stops the motor 41 from being driven. One of the coins 16 of the specified number is retained on the second belt 31 without being advanced to the hopper apparatus 17.

The slot machine 2 assumes a stand-by state awaiting the start of a game, after the magnetic sensor 55 has detected the number of coins corresponding to the coin number specifying button 9 to 11 that has been actuated. The final coin is left on belt 31 while the game is played, including an operation of the start button 4, rotation and stopping of the reels 21 to 23, and the payment of any prize. The unmoved coin is then fed to the hopper apparatus 17 on the passage plate 14*a* only upon playing another game or terminating the game by pressing the return button 12.

The signal generator 71 is connected to the return button 12 for supplying the microcomputer 43 with a return signal. The microcomputer 43 sets the judging circuit 58 so as to output a WRONG signal upon receiving any current from signal generator 71, drives the motor 41, and allows the above final coin left on the second belt 31 to be conveyed toward the hopper apparatus 17. Then, the judging circuit 58 supplies the microcomputer 43 with a WRONG signal for each detecting current from the magnetic sensor 55. All the coins received in the coin containing portion 8 are thereby returned one after another to the coin tray 18 through the coin chute 15.

When the coin containing portion 8 is emptied, the magnetic sensor 55 supplies no detecting current so that no WRONG signal is supplied from the detecting circuit 58. After passage of a predetermined time period in this state, the microcomputer 43 resets the swingable plate 61 and the detecting circuit 58, stops the motor 41 from being driven, and terminates the function of returning coins. If the return button 12 is pressed immediately after pressing one of the coin number specifying buttons 9 to 11, the microcomputer 43 effects not only the above coin return function but also an extra function of returning coins corresponding to the specified number from the hopper apparatus 17 to the coin tray 18.

The operation of the coin supply device in accordance with the present invention will now be described referring to FIGS. 4 to 8. The coins 16 as received in the coin containing portion 8 are placed on the first belt 30 and overlap one another.

Upon pressing, for example, the coin number specifying button 11 for three coins, the motor 41 is driven to drive the drive rollers 35 and 37 via the timing belt 40. Therefore, both transport belts 30 and 31 are moved in the direction of the horizontal arrows of FIGS. 4–8. Because the first belt 30 is inclined, upper ones of the overlapping coins 16 slide on lower ones toward the guide wall 32, so that some of them will be reliably in contact with the guide wall 32 as illustrated in FIG. 2 in a state of laying on their sides on the belt 30. Even when the coins 16 fail to slide down toward the guide wall 32 due to friction between the coins 16 and the belt 30, the coins 16 are nonetheless brought in contact with, and guided by, the guide wall 32 during transport to the separating roller 47, because the guide wall 32 extends obliquely relative to the transport direction. The drive roller 35 transmits rotation to the separating roller 47 via the belt 45 in the counterclockwise direction, and to the nip roller 57 via the gear in the clockwise direction.

Figure 5:
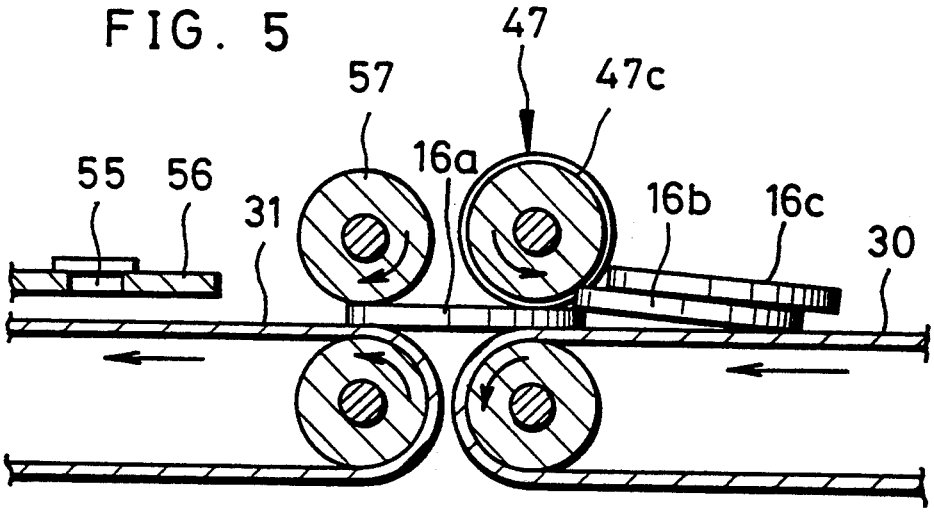

When three coins 16*a* to 16*c* overlapping one another are conveyed to the separating roller 47 on the first belt 30 as illustrated in FIG. 4, the upper two coins 16*b* and 16*c* are in contact with the roller cylinders 47*c* and are pushed back as illustrated in FIG. 5. The lowermost coin 16*a* is not in contact with the roller cylinders 47*c* and is advanced thereunder by the first belt 30.

Figure 6:
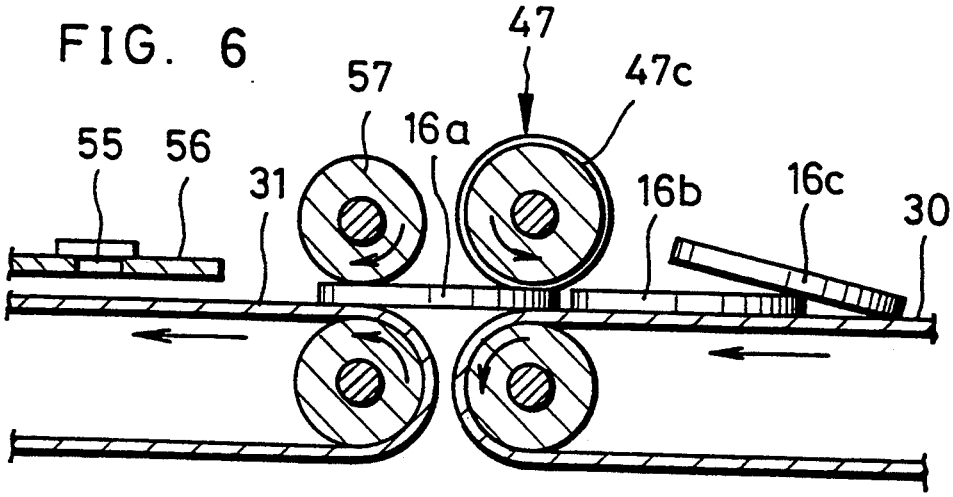
Figure 7:
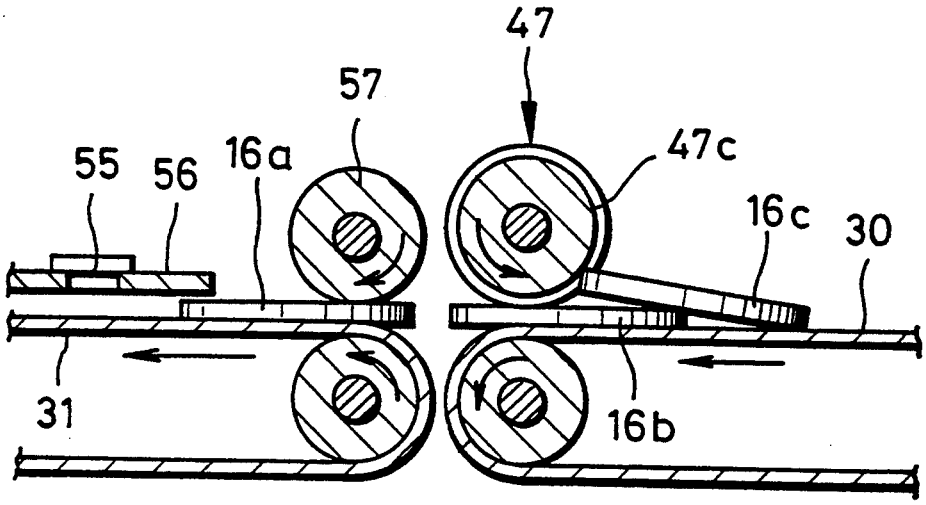
Figure 8:
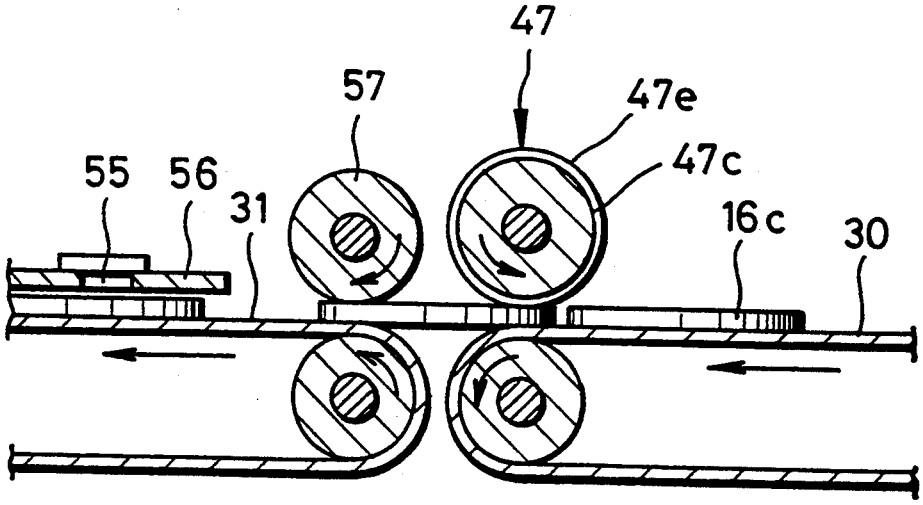

When the rear end of the coin 16*a* is moved to the position below the separating roller 47, the second lowest coin 16*b* slides down from the upper surface of the lowest coin 16*a* as illustrated in FIG. 6. The front end of the coin 16*a* is at this moment in contact with the surface of the second belt 31, and is pressed by the nip roller 57 against the second belt 31. The coin 16*a* being conveyed on the second belt 31 passes below and is kept from contact with the sensor holder 56 as illustrated in FIG. 7. The coins 16 being conveyed on the second belt 31 pass exactly beneath the magnetic sensor 55, due to the inclination of the guide wall 32 relative to the second belt 31. The second belt 31 is moved at a higher speed than the first belt 31, so that it is possible to increase the spacing within a line of coins 16, as illustrated in FIG. 8. The magnetic sensor 55 can thus more reliably detect the individual coins 16.

Although the coin supply device 13 as described according to the above embodiments is used in a slot machine 2, the coin supply device may also be applied in other gaming machines, ending machines or coin-operated machines of any kind.

Although the present invention has been fully described by way of various preferred embodiments thereof and with reference to the accompanying drawings, it is evident that various changes and modifications will be apparent to those having ordinary skill in this field. Therefore, unless these changes and modifications depart form the scope and spirit of the present invention, they should be construed as included therein.

What is claimed is:

1. A coin supply device for automatically supplying a coin-operated machine with coins one by one, comprising:

a coin containing portion for receiving an overlapping plurality of manually-inserted coins;

a first conveyor belt traveling about a first downstream roller and a second upstream roller, for conveying said coins supplied from said coin containing portion;

a first guide wall provided along a conveying direction of said first conveyor belt substantially perpendicular relative to said first conveyor belt for defining a direction of movement of said supplied coins from a lateral side thereof; and a separating roller provided above and directly opposite said first downstream roller and defining with said first conveyor belt at a point where said first conveyor belt passes about said first downstream roller a spacing D satisfying the relation $T<D<2T$ where T is the thickness of a predetermined coin or token, for rotation in the same direction as said first downstream roller thereby to convey a lowermost coin of said supplied overlapping coins on said first conveyor belt to said coin-operated machine and to push back coins overlying said lowermost coin.

2. The coin supply device as claimed in claim 1, wherein said supplied coins are conveyed on said first conveyor belt in a state of lying on their sides thereon.

3. The coin supply device as claimed in claim 2, wherein said coin-operated machine is a slot machine enclosing said first conveyor belt, said first guide wall and said separating roller, and on which said coin containing portion is mounted externally.

4. The coin supply device as claimed in claim 2 further comprising a guide disposed facing said first guide wall for preventing two coins situated side-by-side relative to said conveying direction from passing simultaneously beneath said separating roller.

5. The coin supply device as claimed in claim 4, further comprising:

a partition wall disposed above said separating roller and spaced therefrom a distance less than T, thereby to prevent said coins from passing over said separating roller;

at least one annular groove formed in said separating roller and having an axial width less than the diameter of said coins; and at least one projecting portion formed on said partition wall and extending into said annular groove in order to prevent said coins in cooperation with said annular groove from advancing between said partition wall and said separating roller.

6. The coin supply device as claimed in claim 5, wherein said separating roller comprises at least one cylindrical portion formed beside said annular groove and having a width along said axial direction less than said diameter of said coins.

7. A coin supply device for automatically supplying a coin-operated machine with coins one by one, comprising:

a coin containing portion for receiving an overlapping plurality of manually-inserted coins;

a first conveyor belt traveling about a first downstream roller and a second upstream roller, for conveying said coins supplied from said coin containing portion;

a first guide wall provided along a conveying direction of said first conveyor belt substantially perpendicular relative to said first conveyor belt for defining a direction of movement of said supplied coins from a lateral side thereof; and a separating roller provided above and alongside said first downstream roller and defining with said first conveyor belt a spacing D satisfying the relation $T<D<2T$ where T is the thickness of a predetermined coin or token, for rotation in the same direction as said first downstream roller thereby to convey a lowermost coin of said supplied overlapping coins on said first conveyor belt to said coin-operated machine and to push back coins overlying said lowermost coin, wherein said supplied coins are conveyed on said first conveyor belt in a state of lying on their sides thereon, further comprising a guide disposed facing said first guide wall for preventing two coins situated side-by-side relative to said conveying direction from passing simultaneously beneath said separating roller, wherein said guide is a side roller portion formed integrally with said separating roller.

8. A coin supply device for automatically supplying a coin-operated machine with coins one by one, comprising:

a coin containing portion for receiving an overlapping plurality of manually-inserted coins;

a first conveyor belt traveling about a first downstream roller and a second upstream roller, for conveying said coins supplied from said coin containing portion;

a first guide wall provided along a conveying direction of said first conveyor belt substantially perpendicular relative to said first conveyor belt for defining a direction of movement of said supplied coins from a lateral side thereof; and a separating roller provided above and alongside said first downstream roller and defining with said first conveyor belt a spacing D satisfying the relation $T<D<2T$ where T is the thickness of a predetermined coin or token, for rotation in the same direction as said first downstream roller thereby to convey a lowermost coin of said supplied overlapping coins on said first conveyor belt to said coin-operated machine and to push back coins overlying said lowermost coin, wherein said supplied coins are conveyed on said first conveyor belt in a state of lying on their sides thereon, further comprising a guide disposed facing said first guide wall for preventing two coins situated side-by-side relative to said conveying direction from passing simultaneously beneath said separating roller, wherein said first conveyor belt is oriented in a widthwise inclination such that an outer lateral edge of a side of said first guide wall is lower than an inner lateral edge of an opposite side of said guide wall whereby said coins are urged by gravity into contact with said side of said first guide wall; and said first guide wall extends obliquely relative to said conveying direction such that upstream coins are brought into contact with said first guide wall during conveying on said first conveyor belt.

9. A coin supply device for automatically supplying a coin-operated machine with coins one by one, comprising:

a coin containing portion for receiving an overlapping plurality of manually-inserted coins;

a first conveyor belt traveling about a first downstream roller and a second upstream roller, for conveying said coins supplied from said coin containing portion;

a first guide wall provided along a conveying direction of said first conveyor belt substantially perpendicular relative to said first conveyor belt for defining a direction of movement of said supplied coins from a lateral side thereof; and a separating roller provided above and alongside said first downstream roller and defining with said first conveyor belt a spacing D satisfying the relation $T<D<2T$ where T is the thickness of a predetermined coin or token, for rotation in the same direction as said first downstream roller thereby to convey a lowermost coin of said supplied overlapping coins on said first conveyor belt to said coin-operated machine and to push back coins overlying said lowermost coin, wherein said supplied coins are conveyed on said first conveyor belt in a state of lying on their sides thereon, further comprising a guide disposed facing said first guide wall for preventing two coins situated side-by-side relative to said conveying direction from passing simultaneously beneath said separating roller, further comprising a second conveyor belt disposed downstream of and extending lengthwise beyond and in prolongation of said first conveyor belt for receiving and conveying said coins fed one by one through said spacing D, said second conveyor belt being driven at a speed greater than that of said first conveyor belt in order to increase the spacing between said coins supplied from said first conveyor belt, further comprising:

a sensor disposed over said second conveyor belt for supplying a signal representing passage of a coin thereunder;

judging means for judging whether said passed coin is of a predetermined character, on the basis of said coin signal received from said sensor; and changeover means for changing over a direction of feeding said passed coin conveyed by said second conveyor belt in accordance with the judgment of said judging means;

wherein said direction changeover means includes:

a first coin chute disposed downstream of said second conveyor belt for directing coins toward a hopper apparatus of said slot machine;

a second coin chute disposed downstream of said second conveyor belt and alongside said first coin chute, for directing coins toward a coin outlet of said slot machine;

a movable guide plate for deflecting said coins conveyed by said second conveyor belt to either said first or second coin chute; and means for moving said movable plate in accordance with said judgment of said judging means so as to cause a said coin passed under said sensor to enter said first coin chute when being of said predetermined character and to cause said passed coin to enter said second coin chute when differing from said predetermined character;

further comprising control means for counting coins judged by said judging means as being of said predetermined character; and further comprising a plurality of manually operable coin number specifying switches corresponding to numbers of coins to be played in one game, and adapted to specify said numbers of coins to be fed to said hopper apparatus at once, said control means controlling said movable plate and said first and second conveyor belts in accordance with a coin number signal supplied from any one of said coin number specifying switches in order to feed said specified number of coins to said hopper apparatus.

10. The coin supply device as claimed in claim 9, further comprising a manually operable return switch for causing all said supplied coins to be fed to said coin outlet, said control means controlling said movable plate and said first and second conveyor belts in accordance with a return signal supplied from said return switch.

* * * * *